US006625574B1

(12) United States Patent
Taniguchi et al.

(10) Patent No.: US 6,625,574 B1
(45) Date of Patent: Sep. 23, 2003

(54) METHOD AND APPARATUS FOR SUB-BAND CODING AND DECODING

(75) Inventors: Shohei Taniguchi, Yokohama (JP); Yutaka Banba, Yokohama (JP)

(73) Assignee: Matsushita Electric Industrial., Ltd., Osaka (JP)

( * ) Notice: Subject to any disclaimer, the term of this patent is extended or adjusted under 35 U.S.C. 154(b) by 589 days.

(21) Appl. No.: 09/645,326

(22) Filed: Aug. 25, 2000

(30) Foreign Application Priority Data

Sep. 17, 1999 (JP) ..... 11-264427

(51) Int. Cl.[7] ..... G10L 19/02; G10L 19/00; G10L 19/14; G10L 11/00

(52) U.S. Cl. ..... 704/229; 704/200.1; 704/212; 704/214; 704/230; 704/219; 704/503; 704/225; 381/2; 381/22; 375/240.12; 375/253; 375/240.03

(58) Field of Search ..... 704/229, 214, 704/230, 219, 200.1, 212, 500–504, 205, 258, 203, 225; 375/240.12, 253, 240.03, 240.11, 240.24, 240–243; 381/2, 22

(56) References Cited

U.S. PATENT DOCUMENTS 3,689,840 A 9/1972 Brown et al.
5,511,094 A * 4/1996 Lee et al. ..... 375/243
5,581,653 A 12/1996 Todd
5,590,108 A * 12/1996 Mitsuno et al. ..... 369/59.16
5,606,618 A * 2/1997 Lokhoff et al. ..... 381/2
5,627,938 A 5/1997 Johnston
5,758,315 A * 5/1998 Mori ..... 704/229
5,809,455 A * 9/1998 Nishiguchi et al. ..... 704/214
5,870,703 A * 2/1999 Oikawa et al. ..... 704/200.1

FOREIGN PATENT DOCUMENTS

| | | |
|---|---|---|
| EP | 0384782 | 8/1990 |
| JP | 6-51795 | 2/1994 |
| JP | 6-343168 | 12/1994 |
| JP | 10-336038 | 12/1998 |
| JP | 2001034432 | 4/2001 |

* cited by examiner

*Primary Examiner*—Vijay Chawan
(74) *Attorney, Agent, or Firm*—Louis Woo

(57) ABSTRACT

An input digital audio signal is divided into sub-band signals in respective sub-bands. Scale factors of the respective sub-bands are determined on the basis of the sub-band signals for every frame. Calculation is made as to differences between the determined scale factors for a first frame and the determined scale factors for a second frame preceding the first frame. Absolute values of the calculated scale-factor differences are calculated, and data representative of the calculated absolute values are generated. The data representative of the calculated absolute values are encoded into data of a Huffman code. Sign bits are generated which represent signs of the calculated scale-factor differences. The sub-band signals are quantized in response to the determined scale factors for every frame to generate quantized samples of the sub-band signals. The Huffman-code data, the generated sign bits, and the quantized samples of the sub-band signals are combined into a bit stream.

20 Claims, 10 Drawing Sheets

METHOD AND APPARATUS FOR SUB-BAND CODING AND DECODING

BACKGROUND OF THE INVENTION

1. Field of the Invention

This invention relates to a method of sub-band coding. In addition, this invention relates to a method of sub-band decoding. Furthermore, this invention relates to a sub-band coding apparatus and a sub-band decoding apparatus.

2. Description of the Related Art

Japanese published unexamined patent application 10-336038 discloses a method of encoding an audio signal which includes a step of separating the audio signal into signals in sub-bands. The resultant sub-band signals are encoded frame by frame. In general, scale factors are defined for the sub-band signals respectively. According to the method in Japanese application 10-336038, every frame is divided into a plurality of small frames, and scale factors are reduced in number by making some of them common to plural small frames. The encoding-resultant sub-band signals, and data representative of scale factors are combined into a bit stream. A 1-frame-corresponding portion of the bit stream is composed of a first area assigned to the data of scale factors, and second and later areas corresponding to the respective small frames and assigned to the encoding-resultant sub-band signals. Specifically, the second area is loaded with samples of the encoding-resultant sub-band signals which correspond to a first small frame. The later areas are loaded with samples of the encoding-resultant sub-band signals which correspond to second and later small frames.

According to the method in Japanese application 10-336038, even if scale factors remain unchanged over a plurality of successive frames, a given number of bits representing the scale factors are transmitted for every frame.

SUMMARY OF THE INVENTION

It is a first object of this invention to provide an improved method of sub-band coding.

It is a second object of this invention to provide an improved method of sub-band decoding.

It is a third object of this invention to provide an improved sub-band coding apparatus.

It is a fourth object of this invention to provide an improved sub-band decoding apparatus.

A first aspect of this invention provides a method of sub-band coding. The method comprises the steps of dividing an input digital audio signal into sub-band signals in respective sub-bands; determining scale factors of the respective sub-bands on the basis of the sub-band signals for every frame; calculating differences between the determined scale factors for a first frame and the determined scale factors for a second frame preceding the first frame; calculating absolute values of the calculated scale-factor differences and generating data representative of the calculated absolute values; encoding the data representative of the calculated absolute values into data of a Huffman code; generating sign bits representing signs of the calculated scale-factor differences; quantizing the sub-band signals in response to the determined scale factors for every frame to generate quantized samples of the sub-band signals; and combining the Huffman-code data, the generated sign bits, and the quantized samples of the sub-band signals into a bit stream.

A second aspect of this invention provides a method of sub-band coding. The method comprises the steps of dividing an input digital audio signal into sub-band signals in respective sub-bands; separating the sub-bands into groups on the basis of a perceptual model; determining scale factors of the respective sub-band groups on the basis of the sub-band signals for every frame; calculating differences between the determined scale factors for a first frame and the determined scale factors for a second frame preceding the first frame; calculating absolute values of the calculated scale-factor differences and generating data representative of the calculated absolute values; encoding the data representative of the calculated absolute values into data of a Huffman code; generating sign bits representing signs of the calculated scale-factor differences; quantizing the sub-band signals in response to the determined scale factors for every frame to generate quantized samples of the sub-band signals; and combining the Huffman-code data, the generated sign bits, and the quantized samples of the sub-band signals into a bit stream.

A third aspect of this invention provides a method of sub-band coding. The method comprises the steps of dividing an input digital audio signal into sub-band signals in respective sub-bands; determining scale factors of the respective sub-bands on the basis of the sub-band signals for every frame; calculating differences between the determined scale factors for a first frame and the determined scale factors for a second frame preceding the first frame; calculating absolute values of the calculated scale-factor differences and generating data representative of the calculated absolute values; encoding the data representative of the calculated absolute values into data of a Huffman code; generating sign bits representing signs of the calculated scale-factor differences; generating selection information representing a selected bit-stream format; quantizing the sub-band signals in response to the determined scale factors for every frame to generate quantized samples of the sub-band signals; combining the generated selection information, the Huffman-code data, the generated sign bits, and the quantized samples of the sub-band signals into a bit stream of a first format; generating information flags indicating whether or not the determined scale factors for the first frame are updated from the determined scale factors for the second frame, respectively; selecting one or more of the scale factors in the first frame which are updated from those in the second frame, and generating selected-scale-factor data representative of the selected scale factor or the selected scale factors; combining the generated selection information, the generated information flags, the selected-scale-factor data, and the quantized samples of the sub-band signals into a bit stream of a second format; and selecting one of the bit stream of the first format and the bit stream of the second format as an output bit stream to maximize a number of bits allocated to the samples of the sub-band signals.

A fourth aspect of this invention provides a method of sub-band coding. The method comprises the steps of dividing an input digital audio signal into sub-band signals in respective sub-bands; separating the sub-bands into groups on the basis of a perceptual model; determining scale factors of the respective sub-band groups on the basis of the sub-band signals for every frame; calculating differences between the determined scale factors for a first frame and the determined scale factors for a second frame preceding the first frame; calculating absolute values of the calculated scale-factor differences and generating data representative of the calculated absolute values; encoding the data representative of the calculated absolute values into data of a Huffman code; generating sign bits representing signs of the calculated scale-factor differences; generating selection information representing a selected bit-stream format; quantizing the sub-band signals in response to the determined scale factors for every frame to generate quantized samples of the sub-band signals; combining the generated selection information, the Huffman-code data, the generated sign bits, and the quantized samples of the sub-band signals into a bit stream of a first format; generating information flags indicating whether or not the determined scale factors for the first frame are updated from the determined scale factors for the second frame, respectively; selecting one or more of the scale factors in the first frame which are updated from those in the second frame, and generating selected-scale-factor data representative of the selected scale factor or the selected scale factors; combining the generated selection information, the generated information flags, the selected-scale-factor data, and the quantized samples of the sub-band signals into a bit stream of a second format; and selecting one of the bit stream of the first format and the bit stream of the second format as an output bit stream to maximize a number of bits allocated to the samples of the sub-band signals.

A fifth aspect of this invention is based on the first aspect thereof, and provides a method wherein the sign-bit generating step comprises preventing generation of a sign bit corresponding a calculated scale-factor difference which is equal to zero.

A sixth aspect of this invention is based on the first aspect thereof, and provides a method wherein the Huffman code is of a run-length type.

A seventh aspect of this invention is based on the first aspect thereof, and provides a method further comprising the step of fixing the determined scale factors to maximum values and preventing the determined scale factors from being updated during a predetermined time interval.

An eighth aspect of this invention provides a method of subtend decoding for a bit stream generated by the method in the first aspect of this invention. The method in the eighth aspect of this invention comprises the steps of extracting Huffman-code data from the bit stream; decoding the extracted Huffman-code data into data representative of absolute values of scale-factor differences; extracting sign bits from the bit stream; calculating scale factors of respective sub-bands on the basis of the extracted sign bits and the data representative of the absolute values of the scale-factor differences; deriving first sub-band signals in the respective sub-bands from the bit stream in response to the calculated scale factors; inversely quantizing the first sub-band signals into second sub-band signals in response to the calculated scale factors; and combining the second sub-band signals into an original digital audio signal.

A ninth aspect of this invention provides a method of sub-band decoding for a bit stream generated by the method in the second aspect of this invention. The method in the ninth aspect of this invention comprises the steps of extracting Huffman-code data from the bit stream; decoding the extracted Huffman-code data into data representative of absolute values of scale-factor differences; extracting sign bits from the bit stream; calculating scale factors of respective sub-band groups on the basis of the extracted sign bits and the data representative of the absolute values of the scale-factor differences; deriving first sub-band signals in the respective sub-bands from the bit stream in response to the calculated scale factors; inversely quantizing the first sub-band signals into second sub-band signals in response to the calculated scale factors; and combining the second sub-band signals into an original digital audio signal.

A tenth aspect of this invention provides a method of sub-band decoding for a bit stream generated by the method in third aspect of this invention. The method in the tenth aspect of this invention comprises the steps of detecting selection information in the bit stream; deciding whether the bit stream is of a first format or a second format on the basis of the detected selected information; extracting Huffman-code data from the bit stream when it is decided that the bit stream of the first format; decoding the extracted Huffman-code data into data representative of absolute values of scale-factor differences; extracting sign bits from the bit stream when it is decided that the bit stream of the first format; calculating first scale factors of respective sub-bands on the basis of the extracted sign bits and the data representative of the absolute values of the scale-factor differences; extracting information flags from the bit stream when it is decided that the bit stream is of the second format; extracting selected-scale-factor data from the bit stream when it is decided that the bit stream is of the second format; calculating second scale factors of respective sub-bands on the basis of the extracted information flags and the extracted selected-scale-factor data; deriving first sub-band signals in the respective sub-bands from the bit stream in response to the first scale factors or the second scale factors; inversely quantizing the first sub-band signals into second sub-band signals in response to the first scale factors or the second scale factors; and combining the second sub-band signals into an original digital audio signal.

An eleventh aspect of this invention provides a method of sub-band decoding for a bit stream generated by the method in the fourth aspect of this invention. The method in the eleventh aspect of this invention comprises the steps of detecting selection information in the bit stream; deciding whether the bit stream is of a first format or a second format on the basis of the detected selected information; extracting Huffman-code data from the bit stream when it is decided that the bit stream of the first format; decoding the extracted Huffman-code data into data representative of absolute values of scale-factor differences; extracting sign bits from the bit stream when it is decided that the bit stream of the first format; calculating first scale factors of respective sub-band groups on the basis of the extracted sign bits and the data representative of the absolute values of the scale-factor differences; extracting information flags from the bit stream when it is decided that the bit stream is of the second format; extracting selected-scale-factor data from the bit stream when it is decided that the bit stream is of the second format; calculating second scale factors of the respective sub-band groups on the basis of the extracted information flags and the extracted selected-scale-factor data; deriving first sub-band signals in the respective sub-bands from the bit stream in response to the first scale factors or the second scale factors; inversely quantizing the first sub-band signals into second sub-band signals in response to the first scale factors or the second scale factors; and combining the second sub-band signals into an original digital audio signal.

A twelfth aspect of this invention is based on the eighth aspect thereof, and provides a method wherein the Huffman-code data comprise run-length Huffman code data.

A thirteenth aspect of this invention provides a sub-band coding apparatus comprising means for dividing an input digital audio signal into sub-band signals in respective sub-bands; means for determining scale factors of the respective sub-bands on the basis of the sub-band signals for every frame; means for calculating differences between the determined scale factors for a first frame and the determined scale factors for a second frame preceding the first frame; means for calculating absolute values of the calculated scale-factor differences and generating data representative of the calculated absolute values; means for encoding the data representative of the calculated absolute values into data of a variable-length code; means for generating sign bits representing signs of the calculated scale-factor differences; means for quantizing the sub-band signals in response to the determined scale factors for every frame to generate quantized samples of the sub-band signals; and means for combining the variable-length-code data, the generated sign bits, and the quantized samples of the sub-band signals into a bit stream.

A fourteenth aspect of this invention provides a sub-band coding apparatus comprising means for dividing an input digital audio signal into sub-band signals in respective sub-bands; means for separating the sub-bands into groups on the basis of a perceptual model; means for determining scale factors of the respective sub-band groups on the basis of the sub-band signals for every frame; means for calculating differences between the determined scale factors for a first frame and the determined scale factors for a second frame preceding the first frame; means for calculating absolute values of the calculated scale-factor differences and generating data representative of the calculated absolute values; means for encoding the data representative of the calculated absolute values into data of a variable-length code; means for generating sign bits representing signs of the calculated scale-factor differences; means for quantizing the sub-band signals in response to the determined scale factors for every frame to generate quantized samples of the sub-band signals; and means for combining the variable-length-code data, the generated sign bits, and the quantized samples of the sub-band signals into a bit stream.

A fifteenth aspect of this invention provides a sub-band coding apparatus comprising means for dividing an input digital audio signal into sub-band signals in respective sub-bands; means for determining scale factors of the respective sub-bands on the basis of the sub-band signals for every frame; means for calculating differences between the determined scale factors for a first frame and the determined scale factors for a second frame preceding the first frame; means for calculating absolute values of the calculated scale-factor differences and generating data representative of the calculated absolute values; means for encoding the data representative of the calculated absolute values into data of a variable-length code; means for generating sign bits representing signs of the calculated scale-factor differences; means for generating information flags indicating whether or not the determined scale factors for the first frame are updated from the determined scale factors for the second frame, respectively; means for selecting one or more of the scale factors in the first frame which are updated from those in the second frame, and generating selected-scale-factor data representative of the selected scale factor or the selected scale factors; means for calculating a first sum of a total number of bits of the variable-length-code data and a total number of bits of the sign bits; means for calculating a second sum of a total number of bits of the information flags and a total number of bits of the selected-scale-factor data; means for deciding whether or not the first sum is smaller than the second sum; means for generating selection information in accordance with a result of the deciding whether or not the first sum is smaller than the second sum; means for quantizing the sub-band signals in response to the determined scale factors for every frame to generate quantized samples of the sub-band signals; means for combining the generated selection information, the variable-length-code data, the generated sign bits, and the quantized samples of the sub-band signals into a bit stream when it is decided that the first sum is smaller than the second sum; and means for combining the generated selection information, the generated information flags, the selected-scale-factor data, and the quantized samples of the sub-band signals into a bit stream when it is decided that the first sum is not smaller than the second sum.

A sixteenth aspect of this invention provides a sub-band coding apparatus comprising means for dividing an input digital audio signal into sub-band signals in respective sub-bands; means for separating the sub-bands into groups on the basis of a perceptual model; means for determining scale factors of the respective sub-band groups on the basis of the sub-band signals for every frame; means for calculating differences between the determined scale factors for a first frame and the determined scale factors for a second frame preceding the first frame; means for calculating absolute values of the calculated scale-factor differences and generating data representative of the calculated absolute values; means for encoding the data representative of the calculated absolute values into data of a variable-length code; means for generating sign bits representing signs of the calculated scale-factor differences; means for generating information flags indicating whether or not the determined scale factors for the first frame are updated from the determined scale factors for the second frame, respectively; means for selecting one or more of the scale factors in the first frame which are updated from those in the second frame, and generating selected-scale-factor data representative of the selected scale factor or the selected scale factors; means for calculating a first sum of a total number of bits of the variable-length-code data and a total number of bits of the sign bits; means for calculating a second sum of a total number of bits of the information flags and a total number of bits of the selected-scale-factor data; means for deciding whether or not the first sum is smaller than the second sum; means for generating selection information in accordance with a result of the deciding whether or not the first sum is smaller than the second sum; means for quantizing the sub-band signals in response to the determined scale factors for every frame to generate quantized samples of the sub-band signals; means for combining the generated selection information, the variable-length-code data, the generated sign bits, and the quantized samples of the sub-band signals into a bit stream when it is decided that the first sum is smaller than the second sum; and means for combining the generated selection information, the generated information flags, the selected-scale-factor data, and the quantized samples of the sub-band signals into a bit stream when it is decided that the first sum is not smaller than the second sum.

A seventeenth aspect of this invention provides a sub-band decoding apparatus comprising means for extracting variable-length-code data from a bit stream; means for decoding the extracted variable-length-code data into data representative of absolute values of scale-factor differences; means for extracting sign bits from the bit stream; means for calculating scale factors of respective sub-bands on the basis of the extracted sign bits and the data representative of the absolute values of the scale-factor differences; means for deriving first sub-band signals in the respective sub-bands from the bit stream in response to the calculated scale factors; means for inversely quantizing the first sub-band signals into second sub-band signals in response to the calculated scale factors; and means for combining the second sub-band signals into an original digital audio signal.

An eighteenth aspect of this invention provides a sub-band decoding apparatus comprising means for extracting variable-length-code data from a bit stream; means for decoding the extracted variable-length-code data into data representative of absolute values of scale-factor differences; means for extracting sign bits from the bit stream; means for calculating scale factors of respective sub-band groups on the basis of the extracted sign bits and the data representative of the absolute values of the scale-factor differences; means for deriving first sub-band signals in the respective sub-bands from the bit stream in response to the calculated scale factors; means for inversely quantizing the first sub-band signals into second sub-band signals in response to the calculated scale factors; and means for combining the second sub-band signals into an original digital audio signal.

A nineteenth aspect of this invention provides a sub-band decoding apparatus comprising means for detecting selection information in a bit stream; means for deciding whether the bit stream is of a first format or a second format on the basis of the detected selected information; means for extracting variable-length-code data from the bit stream when it is decided that the bit stream of the first format; means for decoding the extracted variable-length-code data into data representative of absolute values of scale-factor differences; means for extracting sign bits from the bit stream when it is decided that the bit stream of the first format; means for calculating first scale factors of respective sub-bands on the basis of the extracted sign bits and the data representative of the absolute values of the scale-factor differences; means for extracting information flags from the bit stream when it is decided that the bit stream is of the second format; means for extracting selected-scale-factor data from the bit stream when it is decided that the bit stream is of the second format; means for calculating second scale factors of respective sub-bands on the basis of the extracted information flags and the extracted selected-scale-factor data; means for deriving first sub-band signals in the respective sub-bands from the bit stream in response to the first scale factors or the second scale factors; means for inversely quantizing the first sub-band signals into second sub-band signals in response to the first scale factors or the second scale factors; and means for combining the second sub-band signals into an original digital audio signal.

A twentieth aspect of this invention provides a sub-band decoding apparatus comprising means for detecting selection information in a bit stream; means for deciding whether the bit stream is of a first format or a second format on the basis of the detected selected information; means for extracting variable-length-code data from the bit stream when it is decided that the bit stream of the first format; means for decoding the extracted variable-length-code data into data representative of absolute values of scale-factor differences; means for extracting sign bits from the bit stream when it is decided that the bit stream of the first format; means for calculating first scale factors of respective sub-band groups on the basis of the extracted sign bits and the data representative of the absolute values of the scale-factor differences; means for extracting information flags from the bit stream when it is decided that the bit stream is of the second format; means for extracting selected-scale-factor data from the bit stream when it is decided that the bit stream is of the second format; means for calculating second scale factors of the respective sub-band groups on the basis of the extracted information flags and the extracted selected-scale-factor data; means for deriving first sub-band signals in the respective sub-bands from the bit stream in response to the first scale factors or the second scale factors; means for inversely quantizing the first sub-band signals into second sub-band signals in response to the first scale factors or the second scale factors; and means for combining the second sub-band signals into an original digital audio signal.

DESCRIPTION OF THE PREFERRED EMBODIMENTS

First Embodiment

Figure 1:
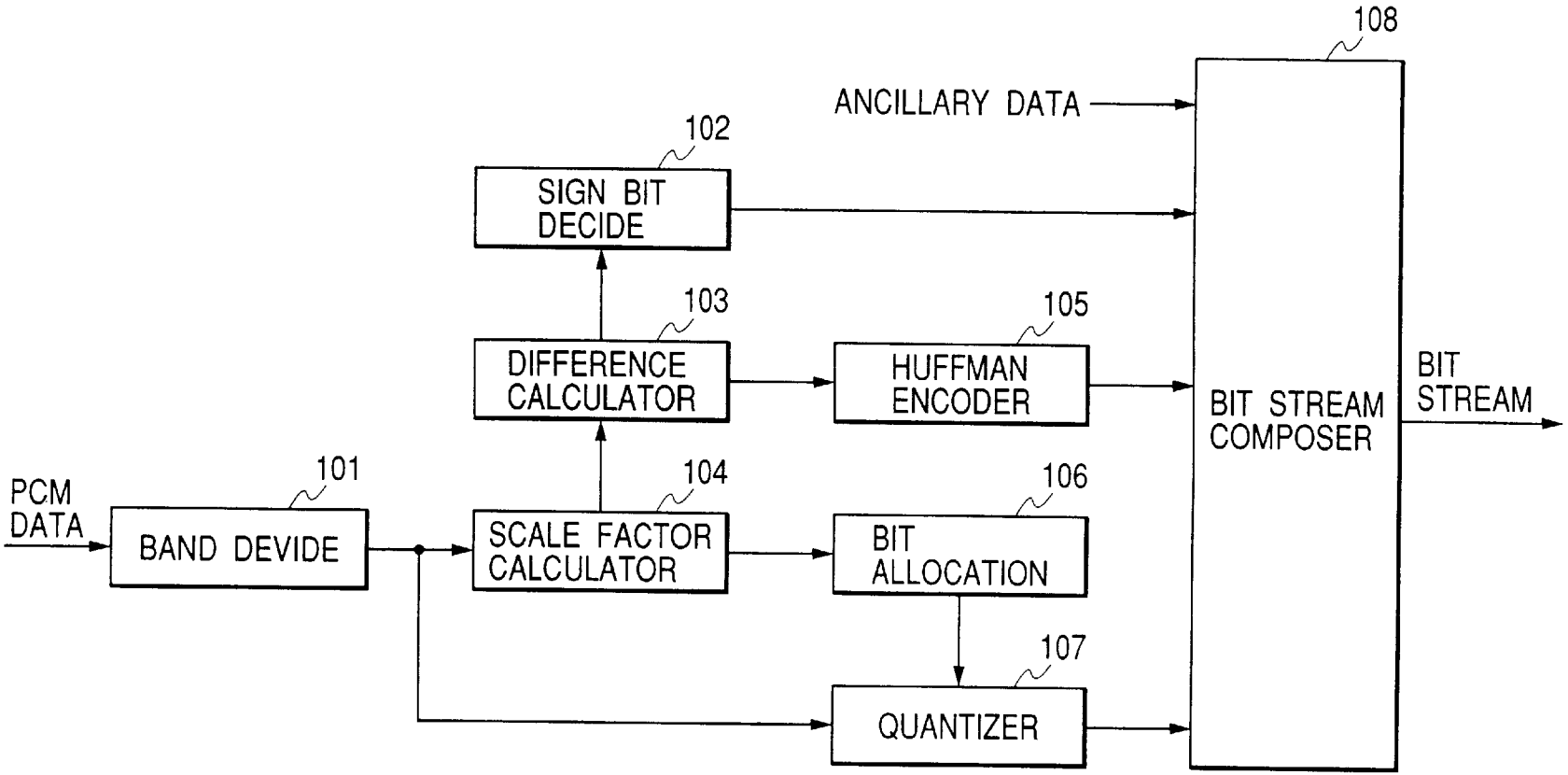
FIG. 1 is a block diagram of a sub-band coding apparatus according to a first embodiment of this invention.

FIG. 1 shows a sub-band coding apparatus according to a first embodiment of this invention. The coding apparatus of FIG. 1 receives an input digital audio signal such as a PCM audio signal. The coding apparatus of FIG. 1 processes the input digital audio signal frame by frame. Here, "frame" means a predetermined time interval corresponding to a given number of successive samples of the input digital audio signal.

The coding apparatus of FIG. 1 includes a band dividing processor 101 receiving the input digital audio signal. The band dividing processor 101 includes band dividing filters (quadrature mirror filters or band pass filters) for separating the input digital audio signal into signals in respective sub-bands which are referred to as first sub-band signals. The band dividing processor 101 further includes down-samplers or sub-samplers for reducing the numbers of samples of the first sub-band signals at a rate of 1/N during every fixed time interval, where "N" denotes the total number of the sub-bands. Thus, the down-samplers or the sub-samplers decimate samples of the first sub-band signals, and thereby convert the first sub-band signals into second sub-band signals respectively. The band dividing processor 101 outputs the second sub-band signals to a scale factor calculator 104 and a quantizer 107.

Every frame is virtually divided into a given number of small frames. A set of N successive samples of the input digital audio signal corresponds to one small frame. Thus, a set of N samples of the respective second sub-band signals corresponds to one small frame.

For every frame (every predetermined time interval), the scale factor calculator 104 scales the second sub-band signals, and calculates scale factors of the second sub-band signals respectively. The scale factors represent magnifications of the second sub-band signals respectively. For every frame, the scale factor calculator 104 informs a difference calculator 103 and a bit allocating section 106 of the calculated scale factors.

The difference calculator 103 subtracts the scale factors of the present frame from the scale factors of the immediately preceding frame (the frame immediately preceding the present frame) for the sub-bands, respectively. Thus, the device 103 calculates the differences between the scale factors of the present frame and the scale factors of the immediately preceding frame for the sub-bands, respectively. For every frame, the difference calculator 103 informs a sign-bit deciding section 102 of the subtraction results, that is, the calculated scale-factor differences. In addition, the device 103 calculates the absolute values of the calculated scale-factor differences. For every frame, the difference calculator 103 informs a Huffman encoder (a variable-length encoder) 105 of the calculated absolute values of the scale-factor differences. Specifically, the difference calculator 103 outputs data representative of the calculated absolute values of the scale-factor differences to the Huffman encoder 105.

For every frame, the device 102 decides the signs of the scale-factor differences and generates bits (sign bits) representing the decided signs of the scale-factor differences. For every frame, the sign-bit deciding section 102 outputs the generated sign bits to a bit-stream composer 108.

Preferably, the sign-bit deciding section 102 operates as follows. For every frame, the sign-bit deciding section 102 determines whether each of the scale-factor differences is equal to or different from "0". In addition, the device 102 decides the signs of the scale-factor differences which are determined to be different from "0". The sign-bit deciding section 102 generates bits (sign bits) representing the decided signs of the non-0 scale-factor differences. The sign-bit deciding section 102 does not generate any sign bits for the scale-factor differences which are determined to be equal to "0". This action by the sign-bit deciding section 102 is effective in increasing the number of bits which can be allocated to quantization-resultant audio information. For every frame, the sign-bit deciding section 102 outputs the generated sign bits to the bit-stream composer 108.

The device 105 encodes the data of the absolute values of the scale-factor differences into words of a Huffman code (a variable-length code), for example, a run-length Huffman code. The Huffman encoder 105 outputs the code words (the code data) representative of the absolute values of the scale-factor differences to the bit-stream composer 108.

For every frame, the bit allocating section 106 decides target numbers of bits allocated to quantization-resultant signal samples on the basis of the scale factors regarding the sub-bands respectively. For every frame, the bit allocating section 106 informs the quantizer 107 of the decided target bit numbers (the bit allocating information).

For every frame, the device 107 quantizes the second sub-band signals into quantization-resultant sub-band signals in response to the target bit numbers, respectively. Samples of each of the quantization-resultant sub-band signals have the same number of bits which is equal to the corresponding target bit number. The quantizer 107 outputs the quantization-resultant sub-band signals to the bit-stream composer 108.

A suitable signal generator (not shown) outputs ancillary data to the bit-stream composer 108.

For every frame, the bit-stream composer 108 combines and multiplexes the sign bits from the sign-bit deciding section 102, the scale-factor difference code data from the Huffman encoder 105, the quantization-resultant sub-band signals from the quantizer 107, and the ancillary data into a 1-frame-corresponding bit stream of a given format. The bit-stream composer 108 outputs the 1-frame-corresponding bit stream to, for example, a transmission line.

Every 1-frame-corresponding bit stream outputted from the bit-stream composer 108 has a sequence of a first area loaded with the scale-factor difference code data, a second area loaded with the sign bits, a third area loaded with the ancillary data, and a fourth area loaded with the quantization-resultant sub-band signals. Preferably, the fourth area has a sequence of sub-areas corresponding to the small frames respectively.

Figure 2:
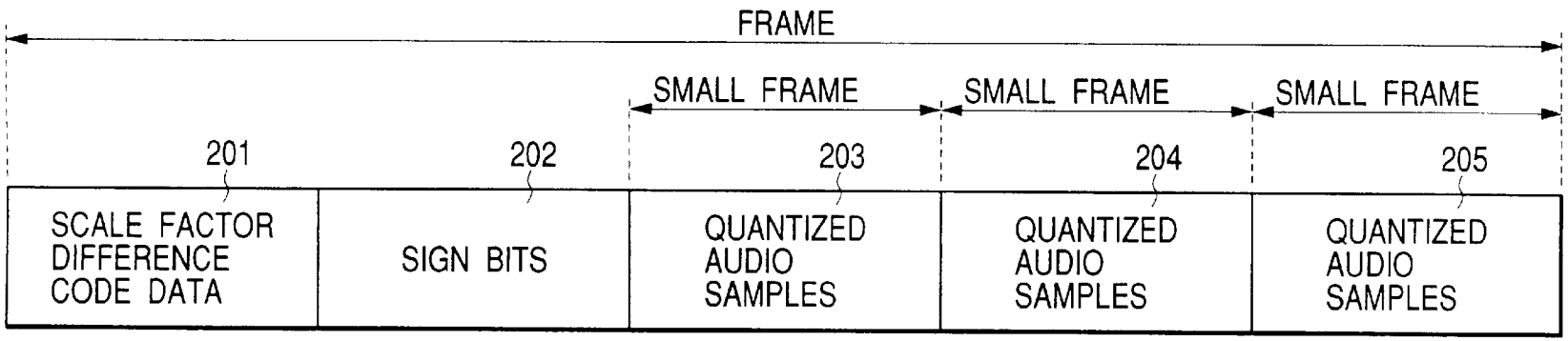
FIG. 2 is a diagram of a 1-frame-corresponding format of a bit stream generated by the coding apparatus of FIG. 1.

The feed of the ancillary data to the bit-stream composer 108 may be omitted. FIG. 2 shows an example of the format of a 1-frame-corresponding bit stream outputted from the bit-stream composer 108 in the absence of the ancillary data. The 1-frame-corresponding bit stream in FIG. 2 has a sequence of a first area 201 loaded with the scale-factor difference code data, a second area 202 loaded with the sign bits, and third, fourth, and fifth areas 203, 204, and 205 loaded with the quantization-resultant sub-band signals. The third, fourth, and fifth areas 203, 204, and 205 correspond to first, second, and third small frames, respectively. Thus, the third area 203 stores samples of the quantization-resultant sub-band signals which correspond to the first small frame. The fourth area 204 stores samples of the quantization-resultant sub-band signals which correspond to the second small frame. The fifth area 204 stores samples of the quantization-resultant sub-band signals which correspond to the third small frame.

The number of bits in one frame is determined by a transmission bit rate and the number of small frames. In the case where frames are fixed in length, a delay time in signal transmission decreases as the number of small frames is reduced.

In the coding apparatus of FIG. 1, the difference calculator 103 10 computes the absolute values of the differences between the scale factors of the present frame and the scale factors of the immediately preceding frame, and the Huffman encoder 105 converts the data of the absolute values of the scale-factor differences into Huffman-code words which are transmitted via the bit-stream composer 108. Accordingly, in the case where the scale factors remain unchanged over a plurality of successive frames, the absolute values of the scale-factor differences continue to be zero. Thus, in this case, only a small number of bits representing the absolute values of the scale-factor differences are transmitted while a larger number of bits are used to indicate the transmitted audio information (the quantization-resultant sub-band signals).

Second Embodiment

Figure 3:
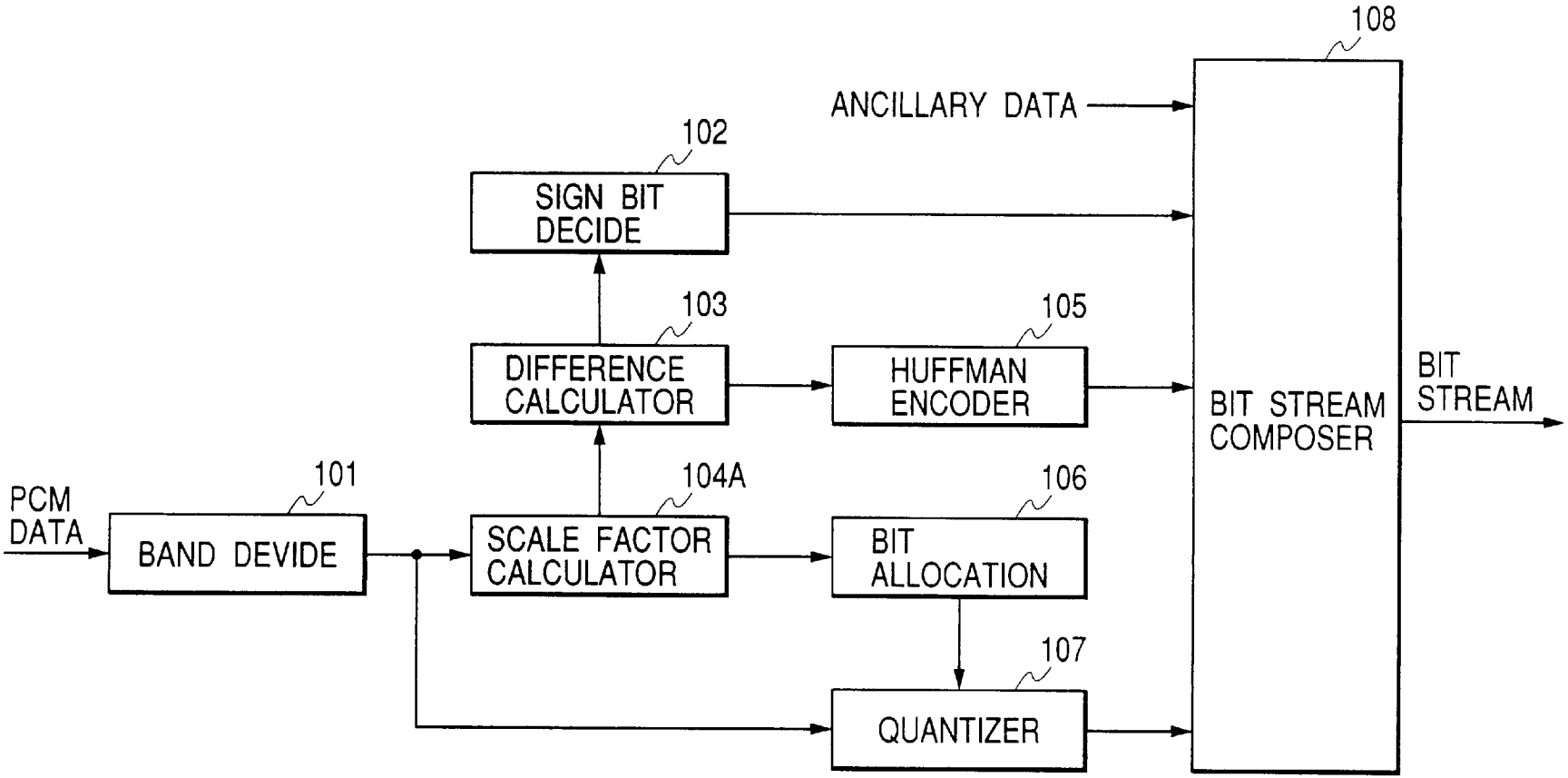
FIG. 3 is a block diagram of a sub-band coding apparatus according to a second embodiment of this invention.

FIG. 3 shows a sub-band coding apparatus according to a second embodiment of this invention. The coding apparatus of FIG. 3 is similar to the coding apparatus of FIG. 1 except that a scale factor calculator 104A replaces the scale factor calculator 104.

In the coding apparatus of FIG. 3, the sub-bands are separated into groups according to a perceptual model or a psychoacoustic model. The grouping of the sub-bands may be on a critical band basis or a coarser unit basis. The scale factor calculator 104A receives second sub-band signals from a band dividing processor 101. The scale factor calculator 104A separates the second sub-band signals into groups in accordance with the grouping of the sub-bands. For every frame (every predetermined time interval), the scale factor calculator 104A scales the second sub-band signals group by group, and calculates scale factors of the groups respectively. The scale factors represent magnifications of the second sub-band signals in the groups. For every frame, the scale factor calculator 104A informs a difference calculator 103 and a bit allocating section 106 of the calculated scale factors.

A mean number of bits allocated to quantization-resultant sub-band signals per frame has been measured under the following conditions. The total number of bits per frame is equal to 170. An input digital audio signal is a PCM audio signal representing female voice pops. The number of small frames for every frame is equal to 2. A transmission bit rate is equal to 128 kbps. The number of groups of scale factors is equal to 9. The scale factors are defined at 6-dB steps. The measured mean number of bits which occurs in the coding apparatus of FIG. 3 is equal to 147. Thus, in the coding apparatus of FIG. 3, 86.5% of all the bits (170 bits) are allocated to the quantization-resultant sub-band signals. On the other hand, the measured mean number of bits which occurs in a prior-art coding apparatus is equal to 134 (a fixed value). Thus, in the prior-art coding apparatus., 78.8% of all the bits (170 bits) are allocated to the quantization-resultant sub-band signals.

Third Embodiment

Figure 4:
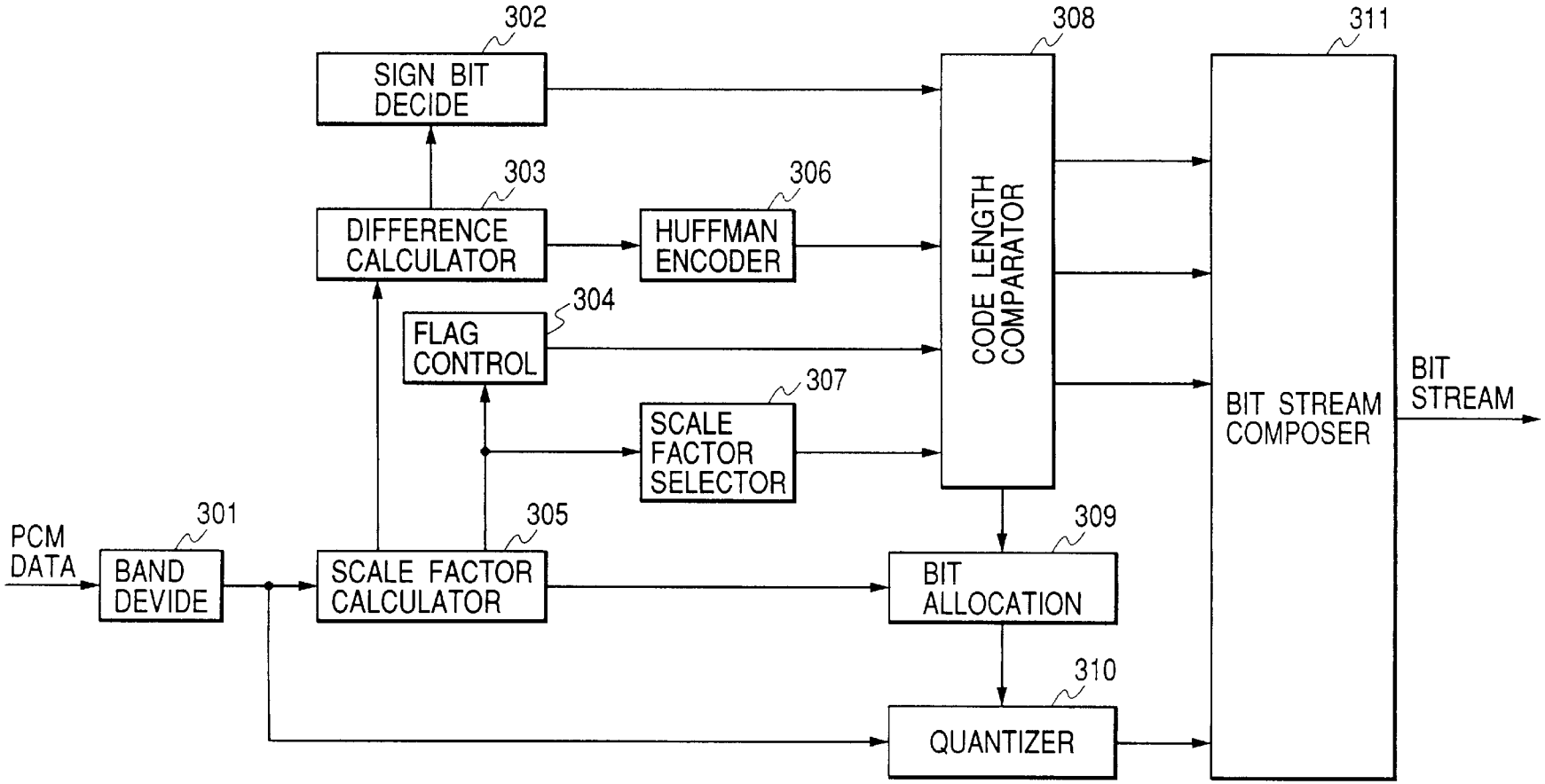
FIG. 4 is a block diagram of a sub-band coding apparatus according to a third embodiment of this invention.

FIG. 4 shows a sub-band coding apparatus according to a third embodiment of this invention. The coding apparatus of FIG. 4 receives an input digital audio signal such as a PCM audio signal.

The coding apparatus of FIG. 4 processes the input digital audio signal frame by frame. Here, "frame" means a predetermined time interval corresponding to a given number of successive samples of the input digital audio signal.

The coding apparatus of FIG. 4 includes a band dividing processor 301 receiving the input digital audio signal. The band dividing processor 301 includes band dividing filters for separating the input digital audio signal into signals in respective sub-bands which are referred to as first sub-band signals. The band dividing processor 301 further includes down-samplers or sub-samplers for reducing the numbers of samples of the first sub-band signals at a rate of 1/N during every fixed time interval, where "N" denotes the total number of the sub-bands. Thus, the down-samplers or the sub-samplers decimate samples of the first sub-band signals, and thereby convert the first sub-band signals into second sub-band signals respectively. The band dividing processor 301 outputs the second sub-band signals to a scale factor calculator 305 and a quantizer 310.

Every frame is virtually divided into a given number of small frames. A set of N successive samples of the input digital audio signal corresponds to one small frame. Thus, a set of N samples of the respective second sub-band signals corresponds to one small frame.

For every frame (every predetermined time interval), the scale factor calculator 305 scales the second sub-band signals, and calculates scale factors of the second sub-band signals respectively. The scale factors represent magnifications of the second sub-band signals respectively. For every frame, the scale factor calculator 305 informs a difference calculator 303, a flag controller 304, a scale-factor selector 307, and a bit allocating section 309 of the calculated scale factors.

The difference calculator 303 subtracts the scale factors of the present frame from the scale factors of the immediately preceding frame (the frame immediately preceding the present frame) for the sub-bands, respectively. Thus, the device 303 calculates the differences between the scale factors of the present frame and the scale factors of the immediately preceding frame for the sub-bands, respectively. For every frame, the difference calculator 303 informs a sign-bit deciding section 302 of the subtraction results, that is, the calculated scale-factor differences. In addition, the device 303 calculates the absolute values of the calculated scale-factor differences. For every frame, the difference calculator 303 informs a Huffman encoder (a variable-length encoder) 306 of the calculated absolute values of the scale-factor differences. Specifically, the difference calculator 303 outputs data representative of the calculated absolute values of the scale-factor differences to the Huffman encoder 306.

For every frame, the device 302 decides the signs of the scale-factor differences and generates bits (sign bits) representing the decided signs of the scale-factor differences. For every frame, the sign-bit deciding section 302 outputs the generated sign bits to a code length comparator 308.

Preferably, the sign-bit deciding section 302 operates as follows. For every frame, the sign-bit deciding section 302 determines whether each of the scale-factor differences is equal to or different from "0". In addition, the device 302 decides the signs of the scale-factor differences which are determined to be different from "0". The sign-bit deciding section 302 generates bits (sign bits) representing the decided signs of the non-0 scale-factor differences. The sign-bit deciding section 302 does not generate any sign bits for the scale-factor differences which are determined to be equal to "0". This action by the sign-bit deciding section 302 is effective in increasing the number of bits which can be allocated to quantization-resultant audio information. For every frame, the sign-bit deciding section 302 outputs the generated sign bits to the code length comparator 308.

The device 306 encodes the data of the absolute values of the scale-factor differences into words of a Huffman code (a variable-length code), for example, a run-length Huffman code. The Huffman encoder 306 outputs the code words (the code data) representative of the absolute values of the scale-factor differences to the code length comparator 308.

The flag controller 304 decides whether or not each of the scale factors in the present frame is updated from that in the immediately preceding frame, that is, whether or not each of the scale factors in the present frame is different from that in the immediately preceding frame. For every frame, the flag controller 304 generates information flags on the basis of the decision results regarding the scale factors, respectively. Each of the information flags indicates whether or not the related scale factor in the present frame is updated from that in the immediately preceding frame. For every frame, the flag controller 304 outputs the generated information flags to the code length comparator 308.

The device 307 selects one or more of the scale factors in the present frame which are updated (different) from those in the immediately preceding frame. For every frame, the scale-factor selector 307 informs the code length comparator 308 of the selected scale factor or the selected scale factors. Specifically, the scale-factor selector 307 outputs data representative of the selected scale factor or the selected scale factors to the code length comparator 308.

For every frame, the code length comparator 308 adds the total number of the sign bits outputted from the sign-bit deciding section 302 and the total number of bits of the scale-factor difference code data outputted from the Huffman encoder 306. This addition result is defined as a first code length (a first total bit number). For every frame, the code length comparator 308 adds the total number of the information flags outputted from the flag controller 304 and the total number of bits of the selected-scale-factor data outputted from the scale factor selector 307. This addition result is defined as a second code length (a second total bit number). The device 308 compares the first code length and the second code length with each other. When the first code length is smaller than the second code length, the code length comparator 308 selects the sign bits outputted from the sign-bit deciding section 302 and the scale-factor difference code data outputted from the Huffman encoder 306 before transmitting them to a bit-stream composer 311. On the other hand, when the second code length is equal to or smaller than the first code length, the code length comparator 308 selects the information flags outputted from the flag controller 304 and the selected-scale-factor data outputted from the scale factor selector 307 before transmitting them to the bit-stream composer 311. For every frame, the code length comparator 308 generates selection information representing which of a set of the output signals from the devices 302 and 306 and a set of the output signals from the devices 304 and 307 is selected, that is, which of a set of the sign bits and the scale-factor difference code data and a set of the information flags and the selected-scale-factor data is selected. The code length comparator 308 outputs the generated selection information to the bit-stream composer 311.

The code length comparator 308 subtracts the smaller of the first and second total bit numbers (the first and second code lengths) from a prescribed total number of bits per frame. The subtraction result is the number of usable bits, that is, bits which can be allocated to quantization-resultant audio information. For every frame, the code length comparator 308 generates information representing the usable bit number. The code length comparator 308 outputs the generated usable-bit-number information to the bit allocating section 309.

For every frame, the bit allocating section 309 decides target numbers of bits allocated to quantization-resultant signal samples on the basis of the scale factors and also the usable-bit-number information regarding the sub-bands respectively. For every frame, the bit allocating section 309 informs the quantizer 310 of the decided target bit numbers (the bit allocating information).

For every frame, the device 310 quantizes the second sub-band signals into quantization-resultant sub-band signals in response to the target bit numbers, respectively. Samples of each of the quantization-resultant sub-band signals have the same number of bits which is equal to the corresponding target bit number. The quantizer 310 outputs the quantization-resultant sub-band signals to the bit-stream composer 311.

For every frame, the bit-stream composer 311 combines and multiplexes the selected signals (that is, selected one of the set of the sign bits and the scale-factor difference code data and the set of the information flags and the selected-scale-factor data) from the code length comparator 308, the selection information from the code length comparator 308, and the quantization-resultant sub-band signals from the quantizer 310 into a 1-frame-corresponding bit stream of a given format. The bit-stream composer 311 outputs the 1-frame-corresponding bit stream to, for example, a transmission line.

Every 1-frame-corresponding bit stream outputted from the bit-stream composer 311 has a sequence of a first area loaded with the selection information, a second area loaded with the selected signals (that is, selected one of the set of the sign bits and the scale-factor difference code data and the set of the information flags and the selected-scale-factor data), and a third area loaded with the quantization-resultant sub-band signals. Preferably, the third area has a sequence of sub-areas corresponding to the small frames respectively.

Figure 5:
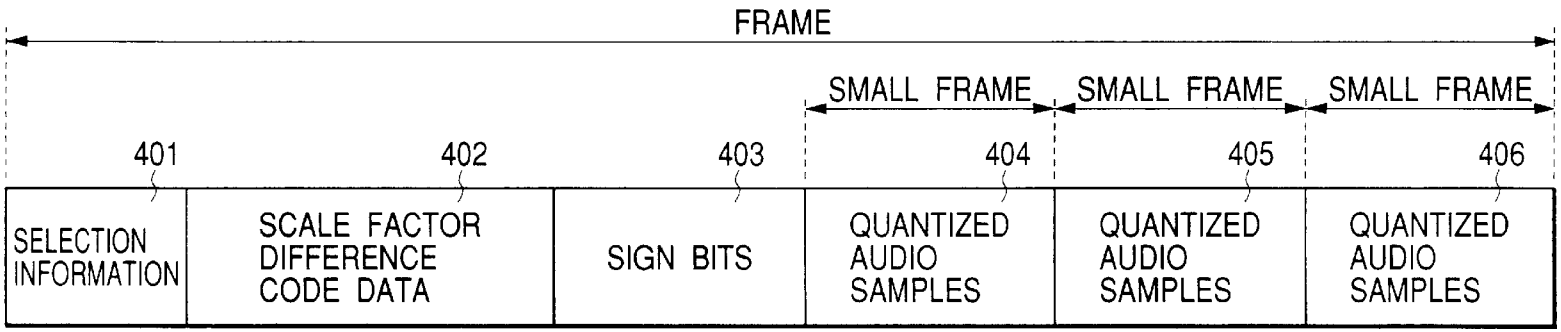
FIG. 5 is a diagram of a first 1-frame-corresponding format of a bit stream generated by the coding apparatus of FIG. 4.

FIG. 5 shows an example of the format of a 1-frame-corresponding bit stream outputted from the bit-stream composer 311 when the set of the sign bits and the scale-factor difference code data is selected. The 1-frame-corresponding bit stream in FIG. 5 has a sequence of a first area 401 loaded with the selection information, a second area 402 loaded with the scale-factor difference code data, a third area 403 loaded with the sign bits, and fourth, fifth, and sixth areas 404, 405, and 406 loaded with the quantization-resultant sub-band signals. The fourth, fifth, and sixth areas 404, 405, and 406 correspond to first, second, and third small frames, respectively. Thus, the fourth area 404 stores samples of the quantization-resultant sub-band signals which correspond to the first small frame. The fifth area 405 stores samples of the quantization-resultant sub-band signals which correspond to the second small frame. The sixth area 406 stores samples of the quantization-resultant sub-band signals which correspond to the third small frame.

Figure 6:
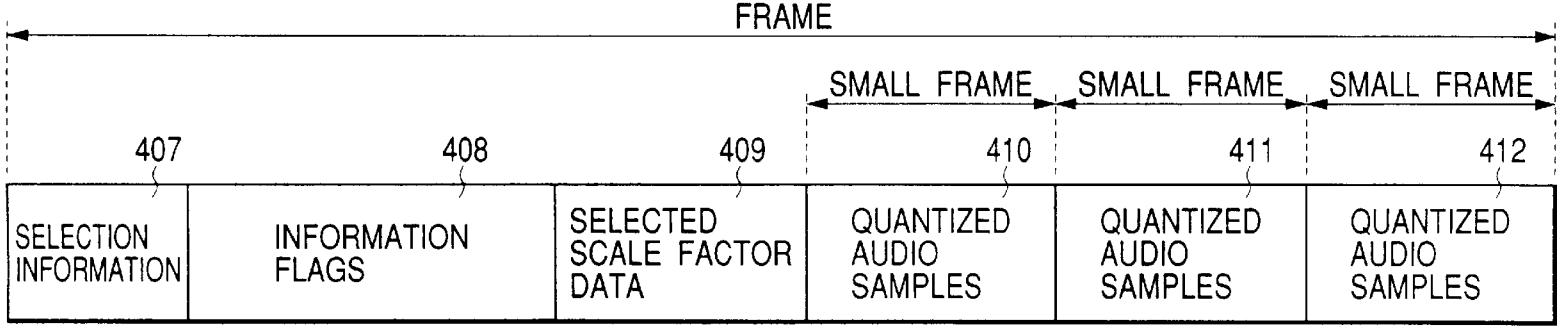
FIG. 6 is a diagram of a second 1-frame-corresponding format of the bit stream generated by the coding apparatus of FIG. 4.

FIG. 6 shows an example of the format of a 1-frame-corresponding bit stream outputted from the bit-stream composer 311 when the set of the information flags and the selected-scale-factor data is selected. The 1-frame-corresponding bit stream in FIG. 6 has a sequence of a first area 407 loaded with the selection information, a second area 408 loaded with the information flags, a third area 409 loaded with the selected-scale-factor data, and fourth, fifth, and sixth areas 410, 411, and 412 loaded with the quantization-resultant sub-band signals. The fourth, fifth, and sixth areas 410, 411, and 412 correspond to first, second, and third small frames, respectively. Thus, the fourth area 410 stores samples of the quantization-resultant sub-band signals which correspond to the first small frame. The fifth area 411 stores samples of the quantization-resultant sub-band signals which correspond to the second small frame. The sixth area 412 stores samples of the quantization-resultant sub-band signals which correspond to the third small frame.

It should be noted that ancillary data may be added to the bit stream outputted from the bit-stream composer 311 as in the coding apparatus of FIG. 1.

The number of bits in one frame is determined by a transmission bit rate and the number of small frames. In the case where frames are fixed in length, a delay time in signal transmission decreases as the number of small frames is reduced.

In the coding apparatus of FIG. 4, the code length comparator 308 selects one of the set of the output signals from the devices 302 and 306 and the set of the output signals from the devices 304 and 307 which has a smaller code length (a smaller total bit number), and the signals in the selected set is transmitted via the bit-stream composer 311. Accordingly, a larger number of bits are used to indicate the transmitted audio information (the quantization-resultant sub-band signals).

Fourth Embodiment

Figure 7:
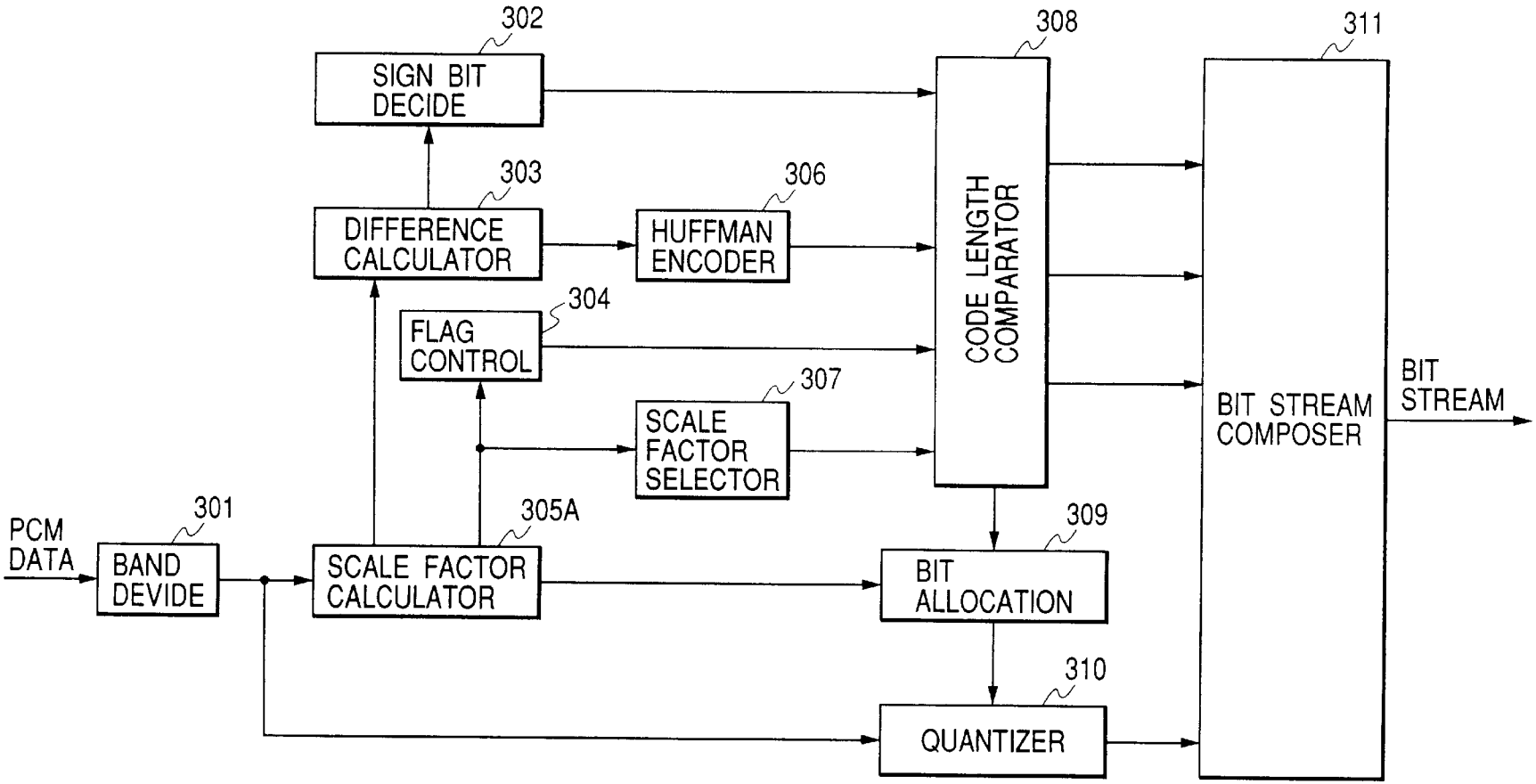
FIG. 7 is a block diagram of a sub-band coding apparatus according to a fourth embodiment of this invention.

FIG. 7 shows a sub-band coding apparatus according to a fourth embodiment of this invention. The coding apparatus of FIG. 7 is similar to the coding apparatus of FIG. 4 except that a scale factor calculator 305A replaces the scale factor calculator 305.

In the coding apparatus of FIG. 7, the sub-bands are separated into groups according to a perceptual model or a psychoacoustic model. The grouping of the sub-bands may be on a critical band basis or a coarser unit basis. The scale factor calculator 305A receives second sub-band signals from a band dividing processor 301. The scale factor calculator 305A separates the second sub-band signals into groups in accordance with the grouping of the sub-bands. For every frame (every predetermined time interval), the scale factor calculator 305A scales the second sub-band signals group by group, and calculates scale factors of the groups respectively. The scale factors represent magnifications of the second sub-band signals in the groups. For every frame, the scale factor calculator 305A informs a difference calculator 303, a flag controller 304, a scale-factor selector 307, and a bit allocating section 309 of the calculated scale factors.

Fifth Embodiment

Figure 8:
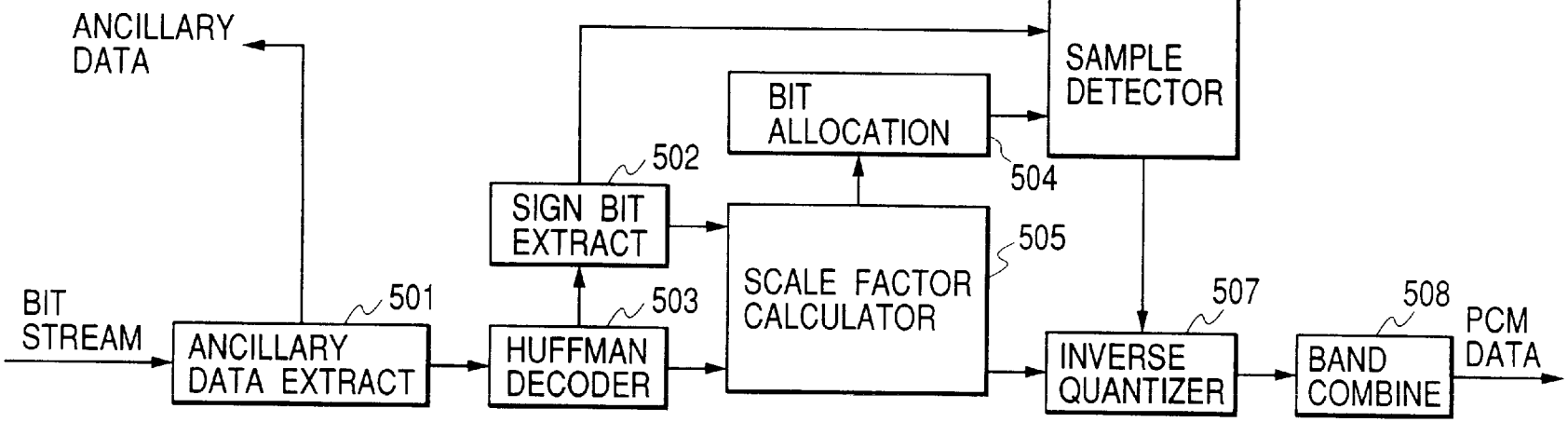
FIG. 8 is a block diagram of a sub-band decoding apparatus according to a fifth embodiment of this invention.

FIG. 8 shows a sub-band decoding apparatus according to a fifth embodiment of this invention. The decoding apparatus of FIG. 8 receives a bit stream from a coding apparatus, for example, the coding apparatus of FIG. 1. The decoding apparatus of FIG. 8 processes the received bit stream frame by frame.

The decoding apparatus of FIG. 8 includes an ancillary data extractor 501 receiving the bit stream. For every frame, the device 501 extracts ancillary data from the bit stream. The ancillary data extractor 501 outputs the extracted ancillary data to a suitable device (not shown). The ancillary data extractor 501 generates an ancillary-data-free bit stream as a result of the extraction of the ancillary data from the received bit stream. The ancillary data extractor 501 outputs the ancillary-data-free bit stream to a Huffman decoder (a variable-length decoder) 503.

For every frame, the Huffman decoder 503 extracts scale-factor difference code data from the ancillary-data-free bit stream. The device 503 decodes the extracted scale-factor difference code data into data of the absolute values of scale-factor differences. The Huffman decoder 503 outputs the data of the absolute values of scale-factor differences to a scale factor calculator 505. The Huffman decoder 503 generates a scale-factor-free bit stream as a result of the extraction of the scale-factor difference code data from the ancillary-data-free bit stream. The Huffman decoder 503 outputs the scale-factor-free bit stream to a sign-bit extractor 502.

For every frame, the device 502 extracts sign bits from the scale-factor-free bit stream. The sign-bit extractor 502 outputs the extracted sign bits to the scale factor calculator 505. The sign-bit extractor 502 generates a sign-bit-free bit stream as a result of the extraction of the sign bits from the scale-factor-free bit stream. The sign-bit extractor 502 outputs the sign-bit-free bit stream to a sample detector 506.

The scale factor calculator 505 computes scale factors of the present frame on the basis of the absolute values of scale-factor differences, the sign bits, and previously-computed scale factors of the immediately preceding frame. The scale factor calculator 505 informs a bit allocation calculator 504 and an inverse quantizer 507 of the computed scale factors of the present frame.

The bit allocation calculator 504 computes numbers of bits allocated to quantization-resultant signal samples on the basis of the scale factors regarding sub-bands respectively. For every frame, the bit allocation calculator 504 informs the sample detector 506 of the computed bit numbers (the bit allocating information).

The sample detector 506 separates the sign-bit-free bit stream into samples of quantization-resultant sub-band signals in response to the bit allocating information. The sample detector 506 outputs the samples of the quantization-resultant sub-band signals to the inverse quantizer 507.

For every frame, the device 507 inversely quantizes the quantization-resultant sub-band signals into first original sub-band signals in response to the scale factors. The inverse quantizer 507 outputs the first original sub-band signals to a band combining processor 508.

The band combining processor 508 includes up-samplers or interpolators for increasing the numbers of samples of the first original sub-band signals at a rate of N during every fixed time interval, where "N" denotes the total number of the sub-bands. Thus, the up-samplers or the interpolators convert the first original sub-band signals into second original sub-band signals. The band combining processor 508 further includes quadrature mirror filters or band pass filters through which the second original sub-band signals are passed. In the band combining processor 508, the sub-band signals outputted from the quadrature mirror filters or the band pass filters are combined into an original digital audio signal such as an original PCM audio signal. In this way, the band combining processor 508 recovers the original digital audio signal. The band combining processor 508 outputs the recovered digital audio signal.

Sixth Embodiment

Figure 9:
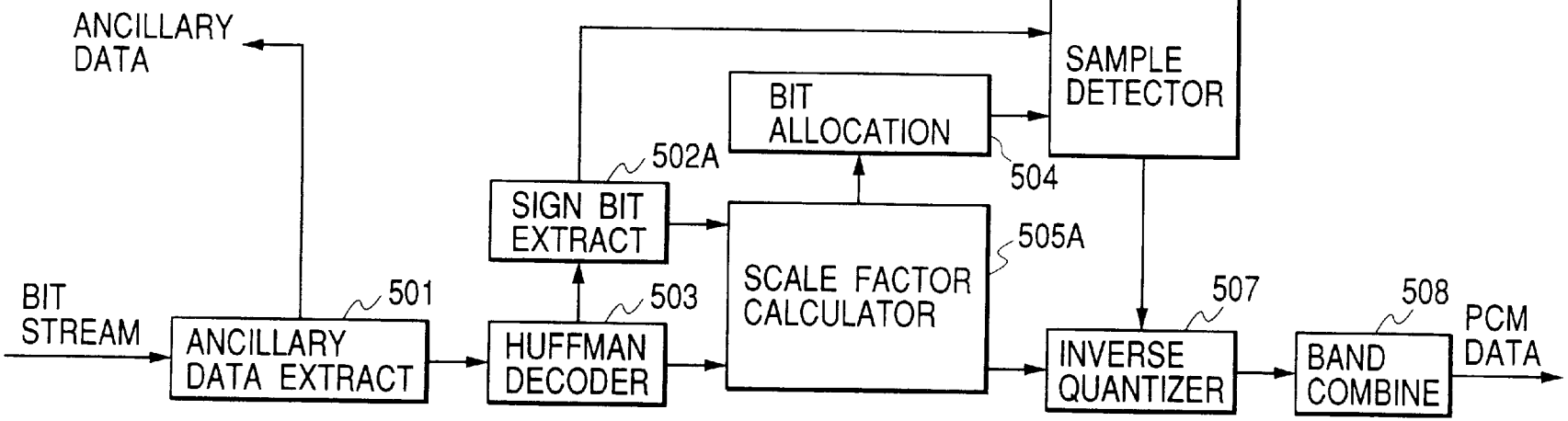
FIG. 9 is a block diagram of a sub-band decoding apparatus according to a sixth embodiment of this invention.

FIG. 9 shows a sub-band decoding apparatus according to a sixth embodiment of this invention. The decoding apparatus of FIG. 9 is similar to the decoding apparatus of FIG. 8 except that a sign-bit extractor 502A and a scale factor calculator 505A replace the sign-bit extractor 502 and the scale factor calculator 505 respectively. The decoding apparatus of FIG. 9 receives a bit stream from a coding apparatus, for example, the coding apparatus of FIG. 3.

In a coding side, sub-bands are separated into groups according to a perceptual model or a psychoacoustic model. For every frame, the device 502A in the decoding apparatus of FIG. 9 extracts sign bits from a scale-factor-free bit stream. The extracted sign bits relate to scale-factor differences of the sub-band groups respectively. The sign-bit extractor 502A outputs the extracted sign bits to the scale factor calculator 505A. The sign-bit extractor 502A generates a sign-bit-free bit stream as a result of the extraction of the sign bits from the scale-factor-free bit stream. The sign-bit extractor 502A outputs the sign-bit-free bit stream to a sample detector 506.

The scale factor calculator 505A computes scale factors of the present frame on the basis of the absolute values of scale-factor differences, the sign bits, and previously-computed scale factors of the immediately preceding frame for the sub-band groups respectively. The scale factor calculator 505A informs a bit allocation calculator 504 and an inverse quantizer 507 of the computed present-frame scale factors of the sub-band groups.

Seventh Embodiment

Figure 10:
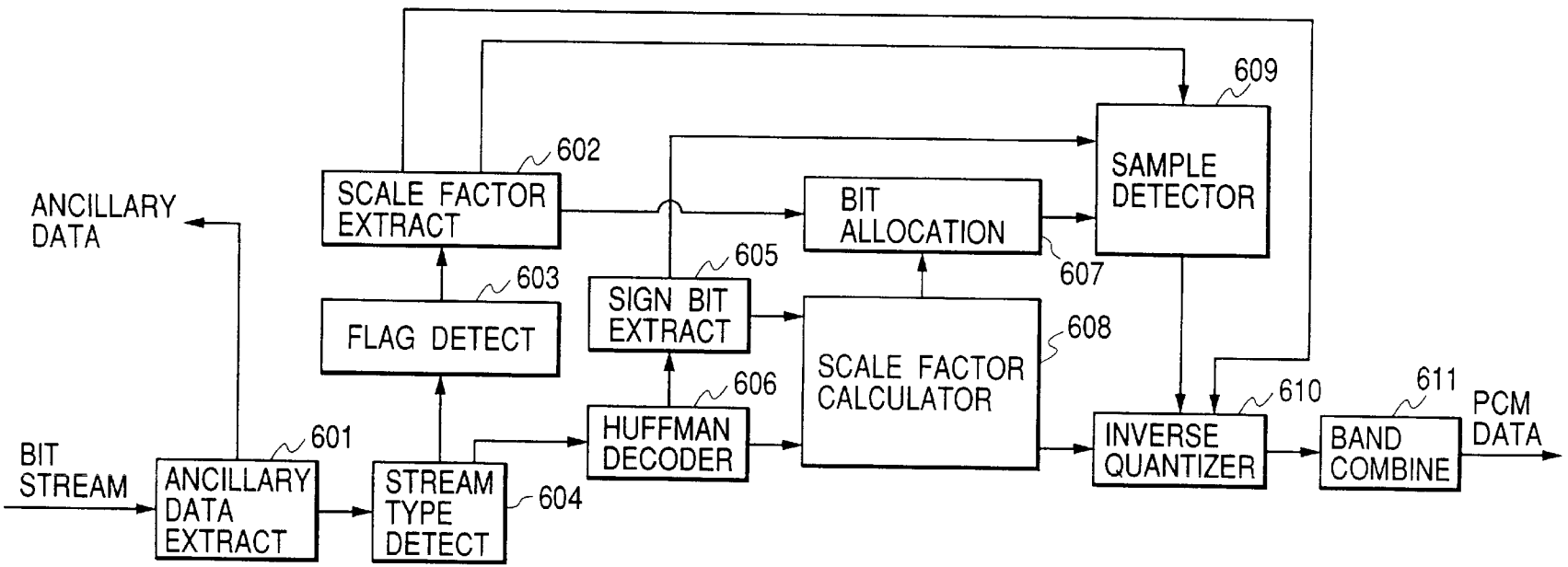
FIG. 10 is a block diagram of a sub-band decoding apparatus according to a seventh embodiment of this invention.

FIG. 10 shows a sub-band decoding apparatus according to a seventh embodiment of this invention. The decoding apparatus of FIG. 10 receives a bit stream from a coding apparatus, for example, the coding apparatus of FIG. 4. The decoding apparatus of FIG. 10 processes the received bit stream frame by frame.

The decoding apparatus of FIG. 10 includes an ancillary data extractor 601 receiving the bit stream. For every frame, the device 601 extracts ancillary data from the bit stream. The ancillary data extractor 601 outputs the extracted ancillary data to a suitable device (not shown). The ancillary data extractor 601 generates an ancillary-data-free bit stream as a result of the extraction of the ancillary data from the received bit stream. The ancillary data extractor 601 outputs the ancillary-data-free bit stream to a bit-stream-type detector 604.

For every frame, the device 604 detects selection information in the ancillary-data-free bit stream. The detected selection information represents which of a set of sign bits and scale-factor difference code data and a set of information flags and selected-scale-factor data is selected. The bit-stream-type detector 604 removes the selection information from the ancillary-data-free bit stream to generate a selection-information-free bit stream. When the detected selection information represents that the set of the sign bits and the scale-factor difference code data is selected, the bit-stream-type detector 604 outputs the selection-information-free bit stream to a Huffman decoder (a variable-length decoder) 606. When the detected selection information represents that the set of the information flags and the selected-scale-factor data is selected, the bit-stream-type detector 604 outputs the selection-information-free bit stream to a flag detector 603.

The Huffman decoder 606 and the following devices 605 and 608 effectively operate in the case where the set of the sign bits and the scale-factor difference code data is selected. On the other hand, the flag detector 603 and the following device 602 effectively operate in the case where the set of the information flags and the selected-scale-factor data is selected.

For every frame, the Huffman decoder 606 extracts scale-factor difference code data from the selection-information-free bit stream. The device 606 decodes the extracted scale-factor difference code data into data of the absolute values of scale-factor differences. The Huffman decoder 606 outputs the data of the absolute values of scale-factor differences to a scale factor calculator 608. The Huffman decoder 606 generates a scale-factor-free bit stream as a result of the extraction of the scale-factor difference code data from the selection-information-free bit stream. The Huffman decoder 606 outputs the scale-factor-free bit stream to a sign-bit extractor 605.

For every frame, the device 605 extracts sign bits from the scale-factor-free bit stream. The sign-bit extractor 605 outputs the extracted sign bits to the scale factor calculator 608. The sign-bit extractor 605 generates a sign-bit-free bit stream as a result of the extraction of the sign bits from the scale-factor-free bit stream. The sign-bit extractor 605 outputs the sign-bit-free bit stream to a sample detector 609.

The scale factor calculator 608 computes scale factors of the present frame on the basis of the absolute values of scale-factor differences, the sign bits, and previously-computed scale factors of the immediately preceding frame. The scale factor calculator 605 informs a bit allocation calculator 607 and an inverse quantizer 610 of the computed scale factors of the present frame.

For every frame, the device 603 detects information flags in the selection-information-free bit stream. Each of the detected information flags indicates whether or not a related scale factor in the present frame is updated (different) from that in the immediately preceding frame. The flag detector 603 outputs the detected information flags to a scale factor extractor 602. The flag detector 603 removes the information flags from the selection-information-free bit stream to generate an information-flag-free bit stream. The flag detector 603 outputs the information-flag-free bit stream to the scale factor extractor 602.

For every frame, the device 602 extracts selected-scale-factor data from the information-flag-free bit stream. The scale factor extractor 602 calculates scale factors of the present frame on the basis of the information flags, the selected-scale-factor data, and previously-calculated scale factors of the immediately preceding frame. The scale factor extractor 602 informs the bit allocation calculator 607 and the inverse quantizer 610 of the calculated scale factors of the present frame. The scale factor extractor 602 generates a scale-factor-free bit stream as a result of the extraction of the selected-scale-factor data from the information-flag-free bit stream. The scale factor extractor 602 outputs the scale-factor-free bit stream to the sample detector 609.

For every frame, the bit allocation calculator 607 responds to the selection information detected by the bit-stream-type detector 604. When the selection information represents that the set of the sign bits and the scale-factor difference code data is selected, the bit allocation calculator 607 uses the scale factors notified by the scale factor calculator 608. On the other hand, when the selection information represents that the set of the information flags and the selected-scale-factor data is selected, the bit allocation calculator 607 uses the scale factors notified by the scale factor extractor 602. The bit allocation calculator 607 computes numbers of bits allocated to quantization-resultant signal samples on the basis of the scale factors regarding sub-bands respectively. For every frame, the bit allocation calculator 607 informs the sample detector 609 of the computed bit numbers (the bit allocating information).

For every frame, the sample detector 609 responds to the selection information detected by the bit-stream-type detector 604. When the selection information represents that the set of the sign bits and the scale-factor difference code data is selected, the sample detector 609 separates the output bit stream from the sign-bit extractor 605 into samples of quantization-resultant sub-band signals in response to the bit allocating information. The sample detector 609 outputs the samples of the quantization-resultant sub-band signals to the inverse quantizer 610. On the other hand, when the selection information represents that the set of the information flags and the selected-scale-factor data is selected, the sample detector 609 separates the output bit stream from the scale factor extractor 602 into samples of quantization-resultant sub-band signals in response to the bit allocating information. The sample detector 609 outputs the samples of the quantization-resultant sub-band signals to the inverse quantizer 610.

For every frame, the inverse quantizer 610 responds to the selection information detected by the bit-stream-type detector 604. When the selection information represents that the set of the sign bits and the scale-factor difference code data is selected, the inverse quantizer 610 uses the scale factors notified by the scale factor calculator 608. On the other hand, when the selection information represents that the set of the information flags and the selected-scale-factor data is selected, the inverse quantizer 610 uses the scale factors notified by the scale factor extractor 602. For every frame, the device 610 inversely quantizes the quantization-resultant sub-band signals into first original sub-band signals in response to the scale factors. The inverse quantizer 610 outputs the first original sub-band signals to a band combining processor 611.

The band combining processor 611 includes up-samplers or interpolators for increasing the numbers of samples of the first original sub-band signals at a rate of N during every fixed time interval, where "N" denotes the total number of the sub-bands. Thus, the up-samplers or the interpolators convert the first original sub-band signals into second original sub-band signals. The band combining processor 611 further includes quadrature mirror filters or band pass filters through which the second original sub-band signals are passed. In the band combining processor 611, the sub-band signals outputted from the quadrature mirror filters or the band pass filters are combined into an original digital audio signal such as an original PCM audio signal. In this way, the band combining processor 611 recovers the original digital audio signal. The band combining processor 611 outputs the recovered digital audio signal.

Eighth Embodiment

Figure 11:
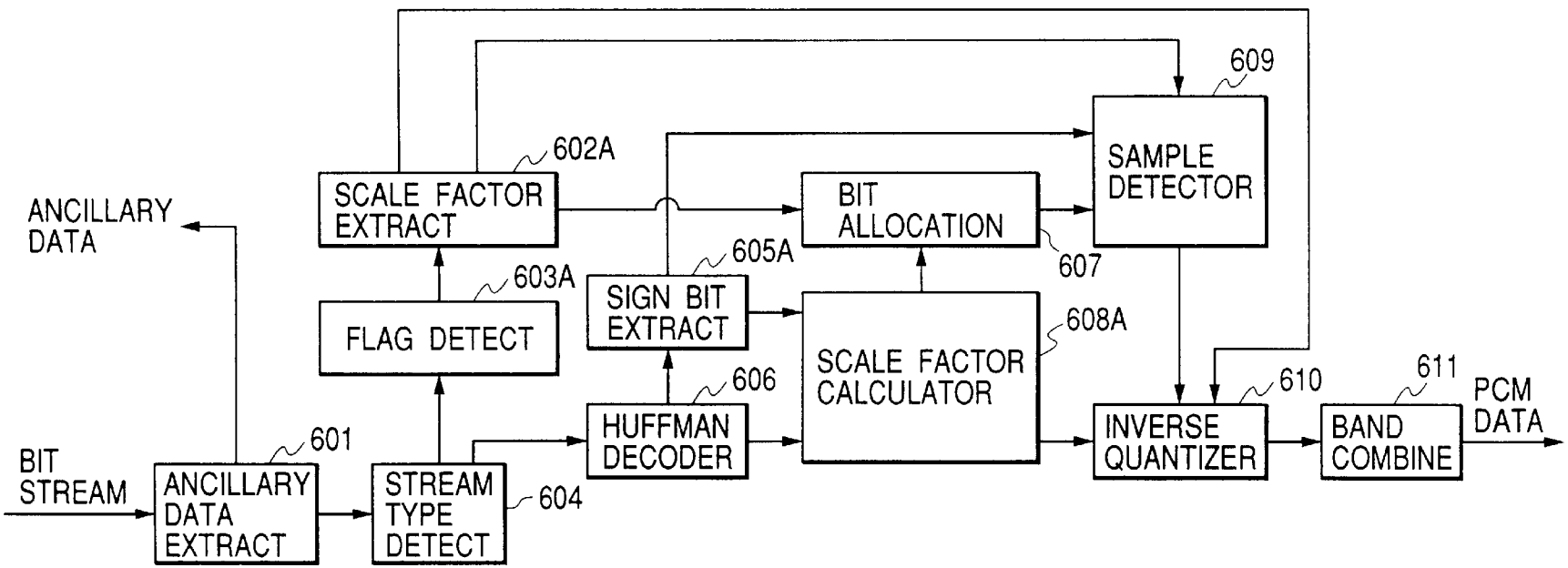
FIG. 11 is a block diagram of a sub-band decoding apparatus according to an eighth embodiment of this invention.

FIG. 11 shows a sub-band decoding apparatus according to an eighth embodiment of this invention. The decoding apparatus of FIG. 11 is similar to the decoding apparatus of FIG. 10 except that a scale factor extractor 602A, a flag detector 603A, a sign-bit extractor 605A, and a scale factor calculator 608A replace the scale factor extractor 602, the flag detector 603, the sign-bit extractor 605, and the scale factor calculator 608 respectively. The decoding apparatus of FIG. 11 receives a bit stream from a coding apparatus, for example, the coding apparatus of FIG. 7.

In a coding side, sub-bands are separated into groups according to a perceptual model or a psychoacoustic model. For every frame, the device 605A in the decoding apparatus of FIG. 11 extracts sign bits from a scale-factor-free bit stream. The extracted sign bits relate to scale-factor differences of the sub-band groups respectively. The sign-bit extractor 605A outputs the extracted sign bits to the scale factor calculator 608A. The sign-bit extractor 605A generates a sign-bit-free bit stream as a result of the extraction of the sign bits from the scale-factor-free bit stream. The sign-bit extractor 605A outputs the sign-bit-free bit stream to a sample detector 609.

The scale factor calculator 608A computes scale factors of the present frame on the basis of the absolute values of scale-factor differences, the sign bits, and previously-computed scale factors of the immediately preceding frame for the sub-band groups respectively. The scale factor calculator 608A informs a bit allocation calculator 607 and an inverse quantizer 610 of the computed present-frame scale factors of the sub-band groups.

For every frame, the device 603A detects information flags in the selection-information-free bit stream. The detected information flags relate to scale factors of the sub-band groups, respectively. Each of the detected information flags indicates whether or not a related scale factor in the present frame is updated (different) from that in the immediately preceding frame. The flag detector 603A outputs the detected information flags to the scale factor extractor 602A. The flag detector 603A removes the information flags from the selection-information-free bit stream to generate an information-flag-free bit stream. The flag detector 603A outputs the information-flag-free bit stream to the scale factor extractor 602A.

For every frame, the device 602A extracts selected-scale-factor data from the information-flag-free bit stream. The scale factor extractor 602A calculates scale factors of the present frame on the basis of the information flags, the selected-scale-factor data, and previously-calculated scale factors of the immediately preceding frame for the sub-band groups respectively. The scale factor extractor 602A informs the bit allocation calculator 607 and the inverse quantizer 610 of the calculated scale factors of the present frame. The scale factor extractor 602A generates a scale-factor-free bit stream as a result of the extraction of the selected-scale-factor data from the information-flag-free bit stream. The scale factor extractor 602A outputs the scale-factor-free bit stream to the sample detector 609.

What is claimed is:

1. A method of sub-band coding, comprising the steps of:

dividing an input digital audio signal into sub-band signals in respective sub-bands;

determining scale factors of the respective sub-bands on the basis of the sub-band signals for every frame;

calculating differences between the determined scale factors for a first frame and the determined scale factors for a second frame preceding the first frame;

calculating absolute values of the calculated scale-factor differences and generating data representative of the calculated absolute values;

encoding the data representative of the calculated absolute values into data of a Huffman code;

generating sign bits representing signs of the calculated scale-factor differences;

quantizing the sub-band signals in response to the determined scale factors for every frame to generate quantized samples of the sub-band signals; and combining the Huffman-code data, the generated sign bits, and the quantized samples of the sub-band signals into a bit stream.

2. A method of sub-band coding, comprising the steps of: dividing an input digital audio signal into sub-band signals in respective sub-bands;

separating the sub-bands into groups on the basis of a perceptual model;

determining scale factors of the respective sub-band groups on the basis of the sub-band signals for every frame;

calculating differences between the determined scale factors for a first frame and the determined scale factors for a second frame preceding the first frame;

calculating absolute values of the calculated scale-factor differences and generating data representative of the calculated absolute values; encoding the data representative of the calculated absolute values into data of a Huffman code;

generating sign bits representing signs of the calculated scale-factor differences; quantizing the sub-band signals in response to the determined scale factors for every frame to generate quantized samples of the sub-band signals; and combining the Huffman-code data, the generated sign bits, and the quantized samples of the sub-band signals into a bit stream.

3. A method of sub-band decoding for a bit stream generated by the method in claim 2, comprising the steps of:

extracting Huffman-code data from the bit stream;

decoding the extracted Huffman-code data into data representative of absolute values of scale-factor differences;

extracting sign bits from the bit stream;

calculating scale factors of respective sub-band groups on the basis of the extracted sign bits and the data representative of the absolute values of the scale-factor differences;

deriving first sub-band signals in the respective sub-bands from the bit stream in response to the calculated scale factors;

inversely quantizing the first sub-band signals into second sub-band signals in response to the calculated scale factors; and combining the second sub-band signals into an original digital audio signal.

4. A method as recited in claim 1, wherein the sign-bit generating step comprises preventing generation of a sign bit corresponding a calculated scale-factor difference which is equal to zero.

5. A method as recited in claim 1, wherein the Huffman code is a run-length type.

6. A method as recited in claim 1, further comprising the step of fixing the determined scale factors to maximum values and preventing the determined scale factors from being updated during a predetermined time interval.

7. A method of sub-band decoding for a bit stream generated by the method in claim 1, comprising the steps of:

extracting Huffman-code data from the bit stream;

decoding the extracted Huffman-code data into data representative of absolute values of scale-factor differences;

extracting sign bits from the bit stream;

calculating scale factors of respective sub-bands on the basis of the extracted sign bits and the data representative of the absolute values of the scale-factor differences;

deriving first sub-band signals in the respective sub-bands from the bit stream in response to the calculated scale factors;

inversely quantizing the first sub-band signals into second sub-band signals in response to the calculated scale factors; and combining the second sub-band signals into an original digital audio signal.

8. A method as recited in claim 7, wherein the Huffman-code data comprise run-length Huffman code data.

9. A method of sub-band coding, comprising the steps of:

dividing an input digital audio signal into sub-band signals in respective sub-bands;

determining scale factors of the respective sub-bands on the basis of the sub-band signals for every frame;

calculating differences between the determined scale factors for a first frame and the determined scale factors for a second frame preceding the first frame;

calculating absolute values of the calculated scale-factor differences and generating data representative of the calculated absolute values;

encoding the data representative of the calculated absolute values into data of a Huffman code;

generating sign bits representing signs of the calculated scale-factor differences;

generating selection information representing a selected bit-stream format;

quantizing the sub-band signals in response to the determined scale factors for every frame to generate quantized samples of the sub-band signals;

combining the generated selection information, the Huffman-code data, the generated sign bits, and the quantized samples of the sub-band signals into a bit stream of a first format;

generating information flags indicating whether or not the determined scale factors for the first frame are updated from the determined scale factors for the second frame, respectively;

selecting one or more of the scale factors in the first frame which are updated from those in the second frame, and generating selected-scale-factor data representative of the selected scale factor or the selected scale factors;

combining the generated selection information, the generated information flags, the selected-scale-factor data, and the quantized samples of the sub-band signals into a bit stream of a second format; and selecting one of the bit stream of the first format and the bit stream of the second format as an output bit stream to maximize a number of bits allocated to the samples of the sub-band signals.

10. A method of sub-band decoding for a bit stream generated by the method in claim 9, comprising the steps of:

detecting selection information in the bit stream;

deciding whether the bit stream is of a first format or a second format on the basis of the detected selected information;

extracting Huffman-code data from the bit stream when it is decided that the bit stream of the first format;

decoding the extracted Huffman-code data into data representative of absolute values of scale-factor differences;

extracting sign bits from the bit stream when it is decided that the bit stream of the first format;

calculating first scale factors of respective sub-bands on the basis of the extracted sign bits and the data representative of the absolute values of the scale-factor differences;

extracting information flags from the bit stream when it is decided that the bit stream is of the second format;

extracting selected-scale-factor data from the bit stream when it is decided that the bit stream is of the second format;

calculating second scale factors of respective sub-bands on the basis of the extracted information flags and the extracted selected-scale-factor data;

deriving first sub-band signals in the respective sub-bands from the bit stream in response to the first scale factors or the second scale factors;

inversely quantizing the first sub-band signals into second sub-band signals in response to the first scale factors or the second scale factors; and combining the second sub-band signals into an original digital audio signal.

11. A method of sub-band coding, comprising the steps of:

dividing an input digital audio signal into sub-band signals in respective sub-bands;

separating the sub-bands into groups on the basis of a perceptual model;

determining scale factors of the respective sub-band groups on the basis of the sub-band signals for every frame;

calculating differences between the determined scale factors for a first frame and the determined scale factors for a second frame preceding the first frame;

calculating absolute values of the calculated scale-factor differences and generating data representative of the calculated absolute values;

encoding the data representative of the calculated absolute values into data of a Huffman code; generating sign bits representing signs of the calculated scale-factor differences;

generating selection information representing a selected bit-stream format;

quantizing the sub-band signals in response to the determined scale factors for every frame to generate quantized samples of the sub-band signals;

combining the generated selection information, the Huffman-code data, the generated sign bits, and the quantized samples of the sub-band signals into a bit stream of a first format;

generating information flags indicating whether or not the determined scale factors for the first frame are updated from the determined scale factors for the second frame, respectively;

selecting one or more of the scale factors in the first frame which are updated from those in the second frame, and generating selected-scale-factor data representative of the selected scale factor or the selected scale factors;

combining the generated selection information, the generated information flags, the selected-scale-factor data, and the quantized samples of the sub-band signals into a bit stream of a second format; and selecting one of the bit stream of the first format and the bit stream of the second format as an output bit stream to maximize a number of bits allocated to the samples of the sub-band signals.

12. A method of sub-band decoding for a bit stream generated by the method in claim 11, comprising the steps of:

detecting selection information in the bit stream;

deciding whether the bit stream is of a first format or a second format on the basis of the detected selected information;

extracting Huffman-code data from the bit stream when it is decided that the bit stream of the first format;

decoding the extracted Huffman-code data into data representative of absolute values of scale-factor differences;

extracting sign bits from the bit stream when it is decided that the bit stream of the first format;

calculating first scale factors of respective sub-band groups on the basis of the extracted sign bits and the data representative of the absolute values of the scale-factor differences;

extracting information flags from the bit stream when it is decided that the bit stream is of the second format;

extracting selected-scale-factor data from the bit stream when it is decided that the bit stream is of the second format;

calculating second scale factors of the respective sub-band groups on the basis of the extracted information flags and the extracted selected-scale-factor data;

deriving first sub-band signals in the respective sub-bands from the bit stream in response to the first scale factors or the second scale factors;

inversely quantizing the first sub-band signals into second sub-band signals in response to the first scale factors or the second scale factors; and combining the second sub-band signals into an original digital audio signal.

13. A sub-band coding apparatus comprising:

means for dividing an input digital audio signal into sub-band signals in respective sub-bands;

means for determining scale factors of the respective sub-bands on the basis of the sub-band signals for every frame;

means for calculating differences between the determined scale factors for a first frame and the determined scale factors for a second frame preceding the first frame;

means for calculating absolute values of the calculated scale-factor differences and generating data representative of the calculated absolute values;

means for encoding the data representative of the calculated absolute values into data of a variable-length code;

means for generating sign bits representing signs of the calculated scale-factor differences;

means for quantizing the sub-band signals in response to the determined scale factors for every frame to generate quantized samples of the sub-band signals; and means for combining the variable-length-code data, the generated sign bits, and the quantized samples of the sub-band signals into a bit stream.

14. A sub-band coding apparatus comprising:

means for dividing an input digital audio signal into sub-band signals in respective sub-bands;

means for separating the sub-bands into groups on the basis of a perceptual model;

means for determining scale factors of the respective sub-band groups on the basis of the sub-band signals for every frame;

means for calculating differences between the determined scale factors for a first frame and the determined scale factors for a second frame preceding the first frame;

means for calculating absolute values of the calculated scale-factor differences and generating data representative of the calculated absolute values;

means for encoding the data representative of the calculated absolute values into data of a variable-length code;

means for generating sign bits representing signs of the calculated scale-factor differences;

means for quantizing the sub-band signals in response to the determined scale factors for every frame to generate quantized samples of the sub-band signals; and means for combining the variable-length-code data, the generated sign bits, and the quantized samples of the sub-band signals into a bit stream.

15. A sub-band coding apparatus comprising:

means for dividing an input digital audio signal into sub-band signals in respective sub-bands;

means for determining scale factors of the respective sub-bands on the basis of the sub-band signals for every frame;

means for calculating differences between the determined scale factors for a first frame and the determined scale factors for a second frame preceding the first frame;

means for calculating absolute values of the calculated scale-factor differences and generating data representative of the calculated absolute values;

means for encoding the data representative of the calculated absolute values into data of a variable-length code;

means for generating sign bits representing signs of the calculated scale-factor differences;

means for generating information flags indicating whether or not the determined scale factors for the first frame are updated from the determined scale factors for the second frame, respectively;

means for selecting one or more of the scale factors in the first frame which are updated from those in the second frame, and generating selected-scale-factor data representative of the selected scale factor or the selected scale factors;

means for calculating a first sum of a total number of bits of the variable-length-code data and a total number of bits of the sign bits;

means for calculating a second sum of a total number of bits of the information flags and a total number of bits of the selected-scale-factor data;

means for deciding whether or not the first sum is smaller than the second sum;

means for generating selection information in accordance with a result of the deciding whether or not the first sum is smaller than the second sum;

means for quantizing the sub-band signals in response to the determined scale factors for every frame to generate quantized samples of the sub-band signals;

means for combining the generated selection information, the variable-length-code data, the generated sign bits, and the quantized samples of the sub-band signals into a bit stream when it is decided that the first sum is smaller than the second sum; and means for combining the generated selection information, the generated information flags, the selected-scale-factor data, and the quantized samples of the sub-band signals into a bit stream when it is decided that the first sum is not smaller than the second sum.

16. A sub-band coding apparatus comprising:

means for dividing an input digital audio signal into sub-band signals in respective sub-bands;

means for separating the sub-bands into groups on the basis of a perceptual model;

means for determining scale factors of the respective sub-band groups on the basis of the sub-band signals for every frame;

means for calculating differences between the determined scale factors for a first frame and the determined scale factors for a second frame preceding the first frame;

means for calculating absolute values of the calculated scale-factor differences and generating data representative of the calculated absolute values;

means for encoding the data representative of the calculated absolute values into data of a variable-length code;

means for generating sign bits representing signs of the calculated scale-factor differences;

means for generating information flags indicating whether or not the determined scale factors for the first frame are updated from the determined scale factors for the second frame, respectively;

means for selecting one or more of the scale factors in the first frame which are updated from those in the second frame, and generating selected-scale-factor data representative of the selected scale factor or the selected scale factors;

means for calculating a first sum of a total number of bits of the variable-length-code data and a total number of bits of the sign bits;

means for calculating a second sum of a total number of bits of the information flags and a total number of bits of the selected-scale-factor data;

means for deciding whether or not the first sum is smaller than the second sum;

means for generating selection information in accordance with a result of the deciding whether or not the first sum is smaller than the second sum;

means for quantizing the sub-band signals in response to the determined scale factors for every frame to generate quantized samples of the sub-band signals;

means for combining the generated selection information, the variable-length-code data, the generated sign bits, and the quantized samples of the sub-band signals into a bit stream when it is decided that the first sum is smaller than the second sum; and means for combining the generated selection information, the generated information flags, the selected-scale-factor data, and the quantized samples of the sub-band signals into a bit stream when it is decided that the first sum is not smaller than the second sum.

17. A sub-band decoding apparatus comprising:

means for extracting variable-length-code data from a bit stream;

means for decoding the extracted variable-length-code data into data representative of absolute values of scale-factor differences;

means for extracting sign bits from the bit stream;

means for calculating scale factors of respective sub-bands on the basis of the extracted sign bits and the data representative of the absolute values of the scale-factor differences, means for deriving first sub-band signals in the respective sub-bands from the bit stream in response to the calculated scale factors;

means for inversely quantizing the first sub-band signals into second sub-band signals in response to the calculated scale factors; and means for combining the second sub-band signals into an original digital audio signal.

18. A sub-band decoding apparatus comprising:

means for extracting variable-length-code data from a bit stream;

means for decoding the extracted variable-length-code data into data representative of absolute values of scale-factor differences;

means for extracting sign bits from the bit stream;

means for calculating scale factors of respective sub-band groups on the basis of the extracted sign bits and the data representative of the absolute values of the scale-factor differences;

means for deriving first sub-band signals in the respective sub-bands from the bit stream in response to the calculated scale factors;

means for inversely quantizing the first sub-band signals into second sub-band signals in response to the calculated scale factors; and means for combining the second sub-band signals into an original digital audio signal.

19. A sub-band decoding apparatus comprising:

means for detecting selection information in a bit stream;

means for deciding whether the bit stream is of a first format or a second format on the basis of the detected selected information;

means for extracting variable-length-code data from the bit stream when it is decided that the bit stream of the first format;

means for decoding the extracted variable-length-code data into data representative of absolute values of scale-factor differences;

means for extracting sign bits from the bit stream when it is decided that the bit stream of the first format;

means for calculating first scale factors of respective sub-bands on the basis of the extracted sign bits and the data representative of the absolute values of the scale-factor differences;

means for extracting information flags from the bit stream when it is decided that the bit stream is of the second format;

means for extracting selected-scale-factor data from the bit stream when it is decided that the bit stream is of the second format;

means for calculating second scale factors of respective sub-bands on the basis of the extracted information flags and the extracted selected-scale-factor data;

means for deriving first sub-band signals in the respective sub-bands from the bit stream in response to the first scale factors or the second scale factors;

means for inversely quantizing the first sub-band signals into second sub-band signals in response to the first scale factors or the second scale factors; and means for combining the second sub-band signals into an original digital audio signal.

20. A sub-band decoding apparatus comprising:

means for detecting selection information in a bit stream;

means for deciding whether the bit stream is of a first format or a second format on the basis of the detected selected information;

means for extracting variable-length-code data from the bit stream when it is decided that the bit stream of the first format;

means for decoding the extracted variable-length-code data into data representative of absolute values of scale-factor differences;

means for extracting sign bits from the bit stream when it is decided that the bit stream of the first format;

means for calculating first scale factors of respective sub-band groups on the basis of the extracted sign bits and the data representative of the absolute values of the scale-factor differences;

means for extracting information flags from the bit stream when it is decided that the bit stream is of the second format;

means for extracting selected-scale-factor data from the bit stream when it is decided that the bit stream is of the second format;

means for calculating second scale factors of the respective sub-band groups on the basis of the extracted information flags and the extracted selected-scale-factor data;

means for deriving first sub-band signals in the respective sub-bands from the bit stream in response to the first scale factors or the second scale factors;

means for inversely quantizing the first sub-band signals into second sub-band signals in response to the first scale factors or the second scale factors; and means for combining the second sub-band signals into an original digital audio signal.

* * * * *

UNITED STATES PATENT AND TRADEMARK OFFICE

CERTIFICATE OF CORRECTION

PATENT NO. : 6,625,574 B1 
DATED : September 23, 2003
INVENTOR(S) : Shohei Taniguchi et al.

It is certified that error appears in the above-identified patent and that said Letters Patent is hereby corrected as shown below:

Title page,
Item [73], Assignee, delete "Matsushita Electric Industrial., Ltd." and insert
-- Matsushita Electric Industrial Co., Ltd. --

Signed and Sealed this

Sixteenth Day of December, 2003

JAMES E. ROGAN
*Director of the United States Patent and Trademark Office*